US006079902A

United States Patent [19]

Pettee, Jr.

[11] Patent Number: 6,079,902

[45] Date of Patent: Jun. 27, 2000

[54] REVETMENT SYSTEM

[75] Inventor: Gary K Pettee, Jr., Belvidere, Ill.

[73] Assignee: Hydropave, L.P., Grapevine, Tex.

[21] Appl. No.: 09/105,917

[22] Filed: Jun. 26, 1998

[51] Int. Cl.[7] ..... E01C 5/06; E01C 11/02; E02B 3/04; E02B 3/14

[52] U.S. Cl. ..... 405/35; 405/20; 405/25; 405/29; 404/35; 404/38; 404/41; 404/42; 52/604; 52/608

[58] Field of Search ..... 405/16, 20, 25, 405/29, 35; 404/35, 38, 40–42; 52/604, 608

[56] References Cited

U.S. PATENT DOCUMENTS

| | | | |
|---|---|---|---|
| 2,017,763 | 10/1935 | Mamula et al. | 52/604 X |
| 2,095,012 | 10/1937 | Renkert | 404/38 |
| 4,372,705 | 2/1983 | Atkinson | 405/16 X |
| 4,474,504 | 10/1984 | Whitman et al. | 405/16 |
| 5,035,532 | 7/1991 | Gargollo | 404/41 |
| 5,224,792 | 7/1993 | Hagenah | 404/41 X |
| 5,251,997 | 10/1993 | Brock | 404/42 X |
| 5,409,325 | 4/1995 | Wu | 52/604 X |
| 5,429,451 | 7/1995 | Pettee, Jr. | 405/20 |
| 5,449,245 | 9/1995 | Glickman | 404/38 |
| 5,503,498 | 4/1996 | Scheiwiller | 404/41 X |
| 5,556,228 | 9/1996 | Smith | 405/16 |
| 5,779,391 | 7/1998 | Knight | 405/20 |
| 5,890,836 | 4/1999 | Leech | 405/16 |
| 5,921,710 | 7/1999 | Scales | 405/20 |

*Primary Examiner*—Eileen Dunn Lillis
*Assistant Examiner*—Tara L. Mayo
*Attorney, Agent, or Firm*—Kajane McManus

[57] ABSTRACT

The improved revetment system is created using a plurality of substantially identical blocks which comprise a body having at least one channel therein leading to a slot and at least one arm extending outwardly of the body and terminating in a locking ear. The ear engages in a slot of an adjacent block and is of less depth than the slot, with the arm being of a length at least equal to and preferably greater than that of the channel, the slot including a removable spacer tab therein which abuts a terminal edge of the ear to keep the blocks spaced apart and an area of the block defined by the arm and ear having an arcuately downwardly sloped top surface with a terminal edge of the ear defining a lowermost position along the arcuate surface.

18 Claims, 4 Drawing Sheets

REVETMENT SYSTEM

BACKGROUND OF THE INVENTION

1. Field of the Invention

The present invention relates to an improved revetment system. More particularly, blocks of the system have been improved to allow for articulation therebetween for conformity to changes in terrain while edges thereof align in a manner to form a smooth transition between the blocks. Further the blocks may be maintained a predetermined distance apart, if desired, by removable spacer tabs incorporated into areas of the blocks used for interlocking the blocks during creation of the revetment system.

2. Prior Art

Heretofore, various revetment systems and blocks used to create such systems have been proposed.

For example, the Atkinson U.S. Pat. No. 4,372,705 discloses an articulated erosion control system which incorporates a complex interlock of lock and key blocks to create a flexible mat, with nominal spacing between the blocks being fixed and with each block having a planar top and bottom surface.

The Gargollo U.S. Pat. No. 5,035,532 discloses a method and apparatus for constructing an articulated pavement system wherein a plurality of substantially identical blocks having planar surfaces are engageable to each other in a puzzle piece manner with substantially no spacing therebetween and with latch pins engageable between adjacent blocks to limit relative vertical movement thereof.

The Pettee, Jr. U.S. Pat. No. 5,429,451 discloses a grid matrix system formed of interconnected blocks having planar surfaces which may be placed adjacent to each other in an abutting manner or in a substantially spaced apart manner while maintaining an interlocked relationship.

As will be described in greater detail hereinafter, the present system is improved by the provision of removable spacer tabs in the areas where blocks of the system lock together for maintaining spacing therebetween, if such is desired, as well as having a non-planar areas on a top surface thereof for producing a smooth transition between adjacent blocks when the blocks are articulated relative to each other, the nonplanar surface areas also affording smooth hydraulic flow over the revetment.

SUMMARY OF THE INVENTION

According to the invention there is provided an improved revetment system comprising a plurality of substantially identical blocks each having a body including at least one channel therein leading to an interior slot and at least one arm extending outwardly of the body and terminating in a locking ear. The ear of one block engages in a slot of an adjacent block and is of less width and depth than the slot, with the arm being of a length at least equal to that of the channel, the slot including a removable spacer tab therein for maintaining the blocks spaced apart and the arm and ear having an arcuately downwardly sloped top surface with a terminal edge of the ear defining a lowermost position along the arc.

DESCRIPTION OF THE PREFERRED EMBODIMENT

Figure 1A:
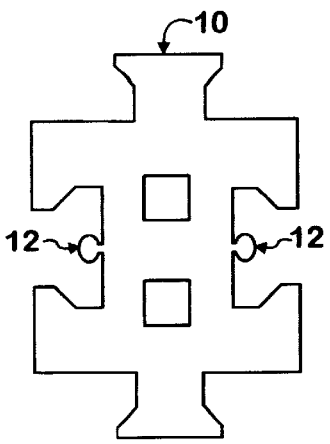
FIGS. 1*a–c* provide a top plan view of a first embodiment of blocks used to create the system of the present invention which are identical except for the number of spacer tabs incorporated thereon.
Figure 1B:
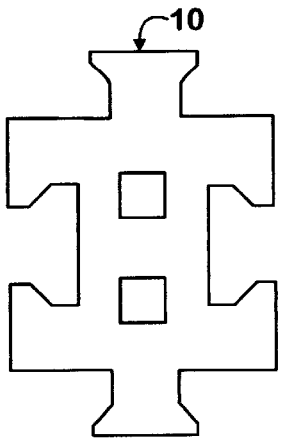
Figure 1C:
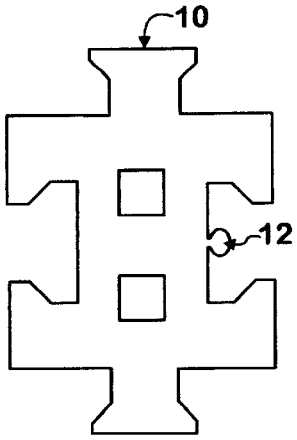
Figure 2A:
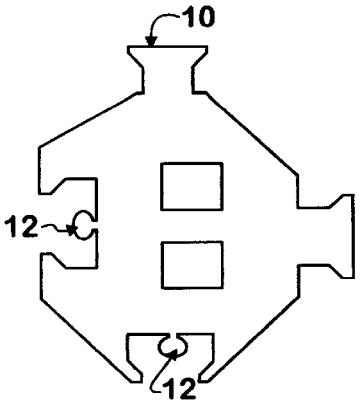
FIG. 2*a–c* provide a top plan view of a second embodiment of blocks used to create the system of the present invention which are identical except for the number of spacer tabs incorporated thereon.
Figure 2B:
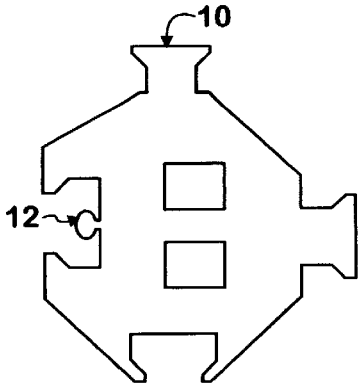
Figure 2C:
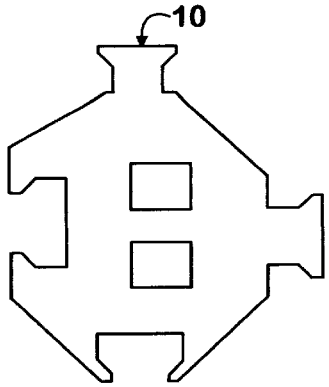
Figure 3A:
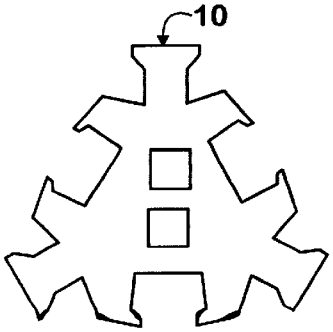
FIG. 3*a–c* provide a top plan view of a third embodiment of blocks used to create the system of the present invention which are identical except for the number of the spacer tabs incorporated thereon.
Figure 3B:
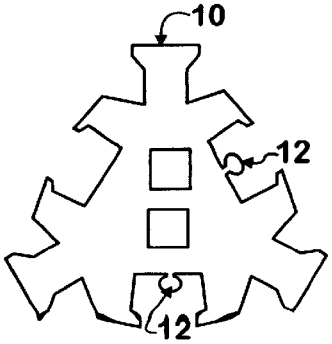
Figure 3C:
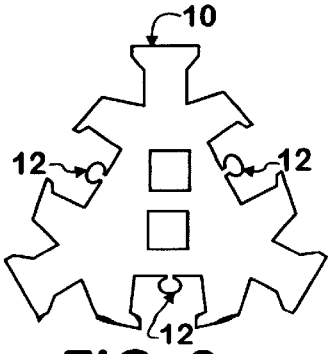

FIGS. 1*a–c* illustrate a first embodiment of a revetment block made in accordance with the teachings of the present invention. FIGS. 2*a–c* illustrate a second embodiment of the revetment block and FIGS. 3*a–c* illustrate a third embodiment of the revetment block, with all embodiments being generally referred to by the reference numeral 10. Within each group of Figures bearing the same numeral, three substantially identical blocks 10 are shown, with the only variation between the blocks 10 of each group being the number of spacer tabs 12 provided on each block 10.

Inasmuch as the embodiments are for purposes of illustration of wide applicability of the invention only, they should not be construed as limiting to the scope of the invention disclosed herein.

Figure 4:
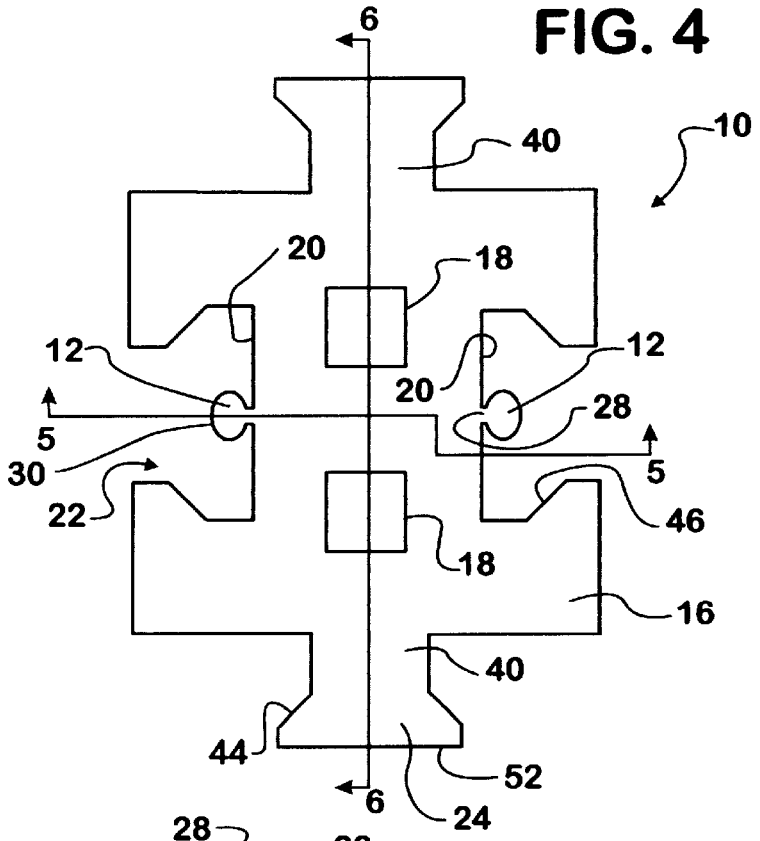
FIG. 4 is an enlarged top plan view of one of the blocks of FIG. 1.
Figure 5:
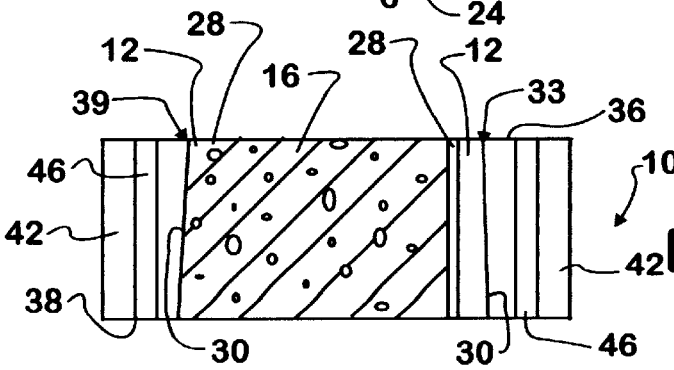
FIG. 5 is a cross sectional view through the block of FIG. 4 taken along line 5—5 of FIG. 4.
Figure 6:
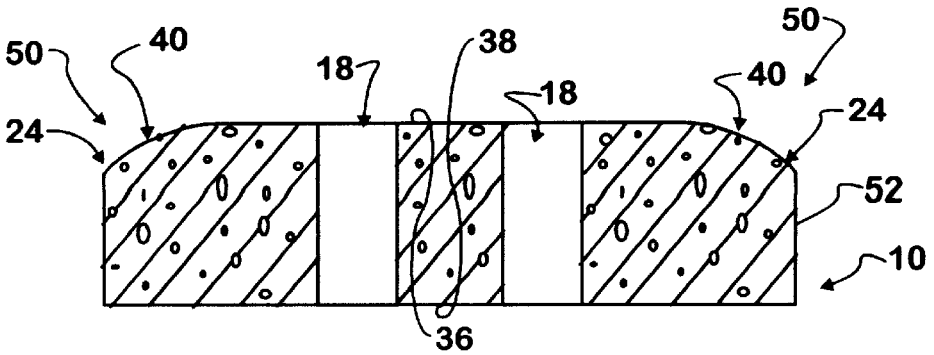
FIG. 6 is a cross sectional view through the block of FIG. 4 taken along line 6—6 of FIG. 4.

Turning now to FIGS. 4–6, it will first be seen that the block 10 of FIG. 4 is similar to the block 10 of FIG. 1*a*, having a solid body 16 with open spaces 18 extending therethrough. The spaces 18 are not necessary for functionality but do provide access to ground therebeneath if, for example, the planting of vegetation is desired or if increased system permeability is needed, for drainage and/or for hydraulic sub-structural pressure relief.

In FIG. 5, a cross sectional view taken along line 5—5 of FIG. 4 is shown. As will be understood from this view, spacer tabs 12 are formed integral with the body 16 extending outwardly from an inner lateral wall 20 of a locking slot 22 within which an ear 24 of an adjacent block 10 is received. The spacer tab 12 is engaged to the body 16 by a narrow neck 28 which allows for removal of the spacer tab 12 using a hammer or like instrument to shear away the thin band of material that defines the neck 28, should a lesser degree of spacing between adjacent blocks 10 and/or increased articulation between adjacent interlocked blocks 10 be desired.

From this Figure it will be further understood that an outer periphery 30 of the spacer tab 12 may be vertical, as shown at 33, or may be configured to increase radially outwardly along its height from a top surface 36 of the block 10 to a bottom surface 38 thereof, as shown at 39, to allow for articulation between engaged blocks 10.

Figure 7:
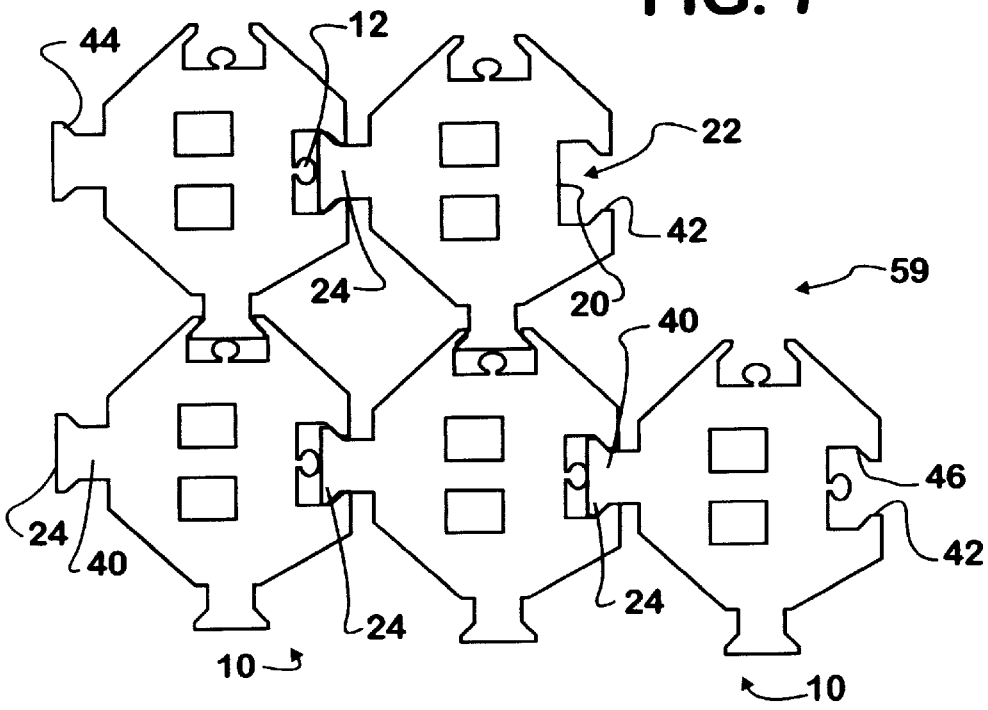
FIG. 7 is a top plan view of an improved revetment system incorporating the blocks of FIG. 2.
Figure 8:
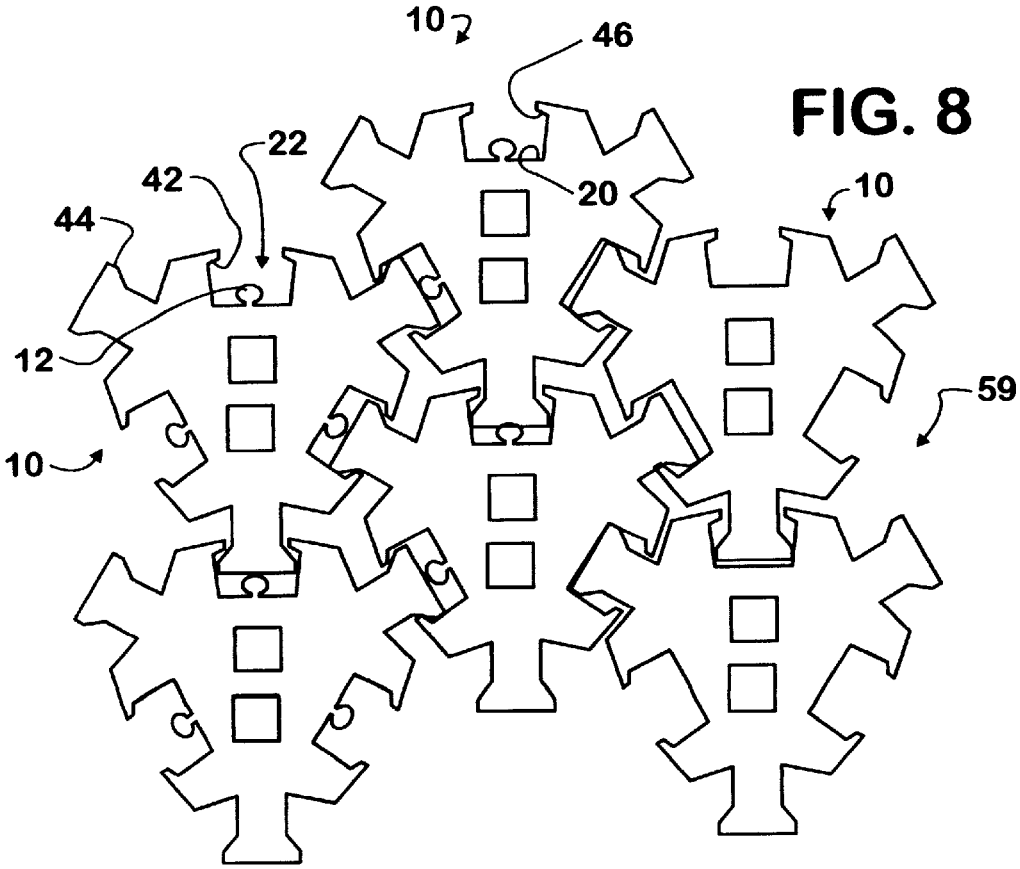
FIG. 8 is a top plan view similar to FIG. 7 except that the blocks shown are those of FIG. 3.
Figure 9:
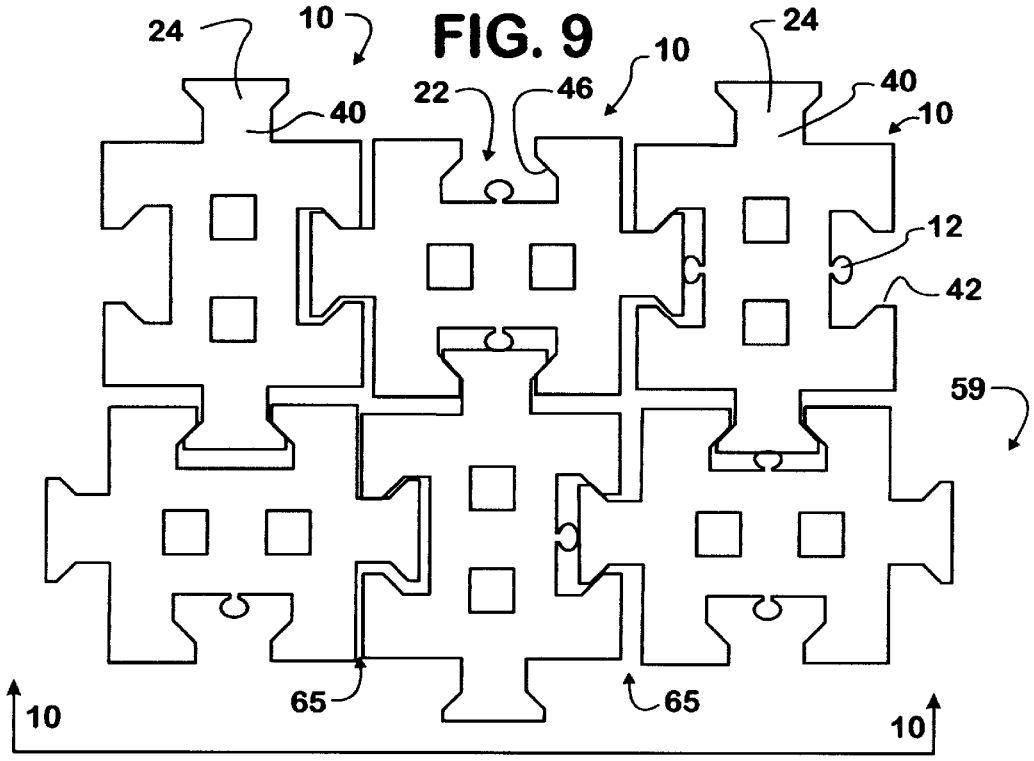
FIG. 9 is a top plan view similar to FIG. 8 except that the blocks shown are those of FIG. 1.

Turning now to a study of the ear 24 of the block 10, it will be seen from FIGS. 7–9 that the ear 24 is sized and configured to be significantly shallower and narrower than the depth and width of the slot 22 within which it is received. Further, the ear 24 is extended outwardly from the body 16 of the block 10 by a narrower elongate arm 40 which is at least as long as, and preferably longer than, an entry channel 42 leading into the slot 22. The arm 40 is slidably engaged within the channel 42 so that the shallow ear 24 may be slid toward or away from the lateral wall 20 of the slot 22, as desired, to reduce or increase, respectively, spacing between adjacent blocks 10.

When the spacer tab 12 is present, in the illustrated embodiment, a desired spacing between the blocks 10 is maintained with a terminal edge 52 of the ear 24 abutting the spacer tab 12. Conversely, when the spacer tab 12 is removed, adjacent blocks 10 maybe positioned in an abutting manner or in any manner up to being maximally spaced apart with a rear wall 44 of the ear 24 abutting outer end wall 46 of the slot 22, extending to either side of the entry channel 42.

Turning now to FIG. 6, a cross sectional view through block 10 taken along line 6—6 of FIG. 4 is illustrated. It will be seen here that, although the top surface 36 of the body of the block 10 is substantially planar and parallel to the bottom surface 38 of the block 10, a top surface area 50 defined by the arm 40 and its terminal ear 24 slopes arcuately downwardly from the top surface 36, with a terminal edge 52 of the ear 24 defining the lowermost point along the arc of area 50. The arcuate configuration of top surface area 50 serves a two fold purpose.

First, as stated hereinabove, the provision of the arcuate configuration produces a smooth area of transition 54 between adjacent blocks 10 in the area of locking therebetween when the locked together blocks 10 are articulated relative to one another.

Figure 10:
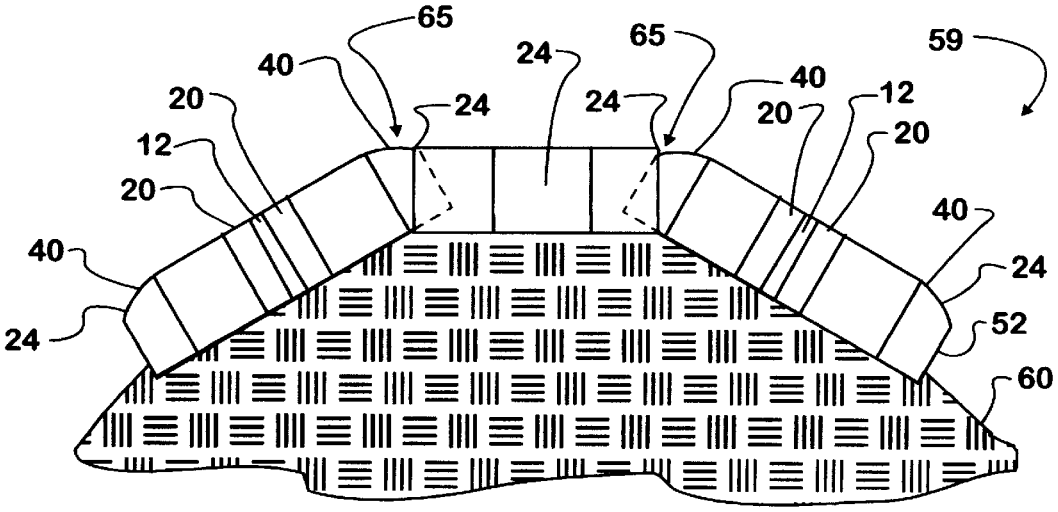
FIG. 10 is a side view through the system of FIG. 9 showing same positioned over a curved surface.

In this respect, when a revetment system 56, comprising a matrix 58 of interlocked blocks 10 is placed over an unevenly countoured surface 60, as shown in FIG. 10, adjacent blocks 10 pivot (articulate) relative to one another about the area of locking or transition 54, out of coplanarity.

When an ear which is co-planar with a top surface of the block pivots vertically within a cooperating slot of an engaged block, depending on the relative angle therebetween, the terminal edge of the ear often elevates above the level of the top surface of the engaged block, creating a jagged pattern across the surface of the revetment system 56. To assure as smooth a surface across the revetment system 56 as possible, the arcuate areas 50 of the blocks 10 have been provided and, as shown in the FIG. 10, avoid the creation of a jagged contour to the revetment system 56 by being able to rise a greater distance before becoming exposed.

Further the arcuate sloping in the areas 50 produces unobstructed water flow over the top surface 36 of the blocks 10 thereby promoting smoother flow and reducing hydraulic turbulence and drag on the revetment system 56.

As described above, the blocks 10 and the revetment system formed therewith provide a number of advantages, some of which have been described above and others of which are inherent in the invention. Also, modifications may be proposed to the structures disclosed above without departing from the teachings herein. For example, although the slot 22 and channel 42 are shown as being full thickness structures, this should not be construed as limiting. Accordingly, the scope of the invention is only to be limited as necessitated by the accompanying claims.

I claim:

1. A block for use in creating a revetment system, the block having a body including at least one lateral channel terminating in an interior slot incorporating a removable spacer tab therein and at least one ear engaged by an arm extending laterally outwardly of the body, the arm being of a length at least equal to a length of the at least one channel and the at least one ear having a width and depth less than a width and depth of the slot.

2. The block of claim 1 wherein a top surface area of the block defined by the arm and the at least one ear slopes arcuately downwardly from a top surface of the body in a manner such that a terminal edge of the at least one ear defines a lowermost point along the arc.

3. A block for use in creating a revetment system, the block having a body including at least one lateral channel terminating in an interior slot and at least one ear engaged by an arm extending laterally outwardly of the body, a top surface area of the block defined by the arm and the at least one ear sloping arcuately downwardly from a top surface of the body in a manner such that a terminal edge of the ear defines a lowermost point along the arc.

4. The block of claim 3 wherein a removable spacer tab is incorporated into said slot.

5. A block for use in creating a revetment system, the block having a body including at least one lateral channel terminating in an interior slot and at least one ear engaged by an arm extending laterally outwardly of the body, the arm being of a length at least equal to a length of the at least one channel and the at least one ear having a width and depth less than a width and depth of the slot, the slot incorporating a removable spacer tab and a top surface area of the block defined by the arm and the at least one ear sloping arcuately downwardly from a top surface of the body in a manner such that a terminal edge of the at least one ear defines a lowermost point along the arc.

6. The block of claim 5 wherein said interior slot has an inner lateral wall.

7. The block of claim 6 wherein said spacer tab extends into said slot from said inner lateral wall.

8. The block of claim 7 wherein said spacer tab is engaged to said inner lateral wall by a narrow neck.

9. The block of claim 8 wherein said spacer tab abuts the terminal edge of an ear of an adjacent block which is engaged within said slot.

10. The block of claim 9 wherein said ear of said adjacent block slides toward and away from said lateral wall when said spacer tab is removed.

11. The block of claim 10 wherein an arm of said adjacent block is slidably engaged within said at least one lateral channel leading to said slot.

12. The block of claim 11 wherein a plurality of adjacent blocks engage each other in the form of a matrix to produce a revetment system.

13. The block of claim 12 having a plurality of arms.

14. The block of claim 12 having a plurality of interior slots.

15. The block of claim 12 having an equal plurality of arms and interior slots.

16. A revetment system comprising a plurality of interlocking blocks, each block having a body including at least one lateral channel terminating in an interior slot and at least one ear engaged by an arm extending laterally outwardly of the body, the arm being of a length at least equal to a length of the at least one channel and the ear having a width and depth less than a width and depth of the slot, the slot incorporating a removable spacer tab therein against which a terminal edge of the ear of an adjacent block abuts to maintain a spaced relationship between the blocks.

17. A revetment system comprising a plurality of interlocking blocks, each block having a body including at least one lateral channel terminating in an interior slot and at least one ear engaged by an arm extending laterally outwardly of the body, a top surface area of the block defined by the arm and the at least one ear sloping arcuately downwardly from a top surface of the body in a manner such that a terminal edge of the at least one ear defines a lowermost point along the arc so that the at least one ear can rise a predetermined distance when the blocks are articulated relative to each other without creating a jagged contour across the revetment system.

18. A revetment system comprising a plurality of interlocking blocks, each block having a body including at least one lateral channel terminating in an interior slot incorporating a removable spacer tab and at least one ear engaged by an arm extending laterally outwardly of the body, the arm being of a length at least equal to a length of the at least one channel and the at least one ear having a width and depth less than a width an depth of the slot, and a top surface area of the block defined by the arm and the at least one ear sloping arcuately downwardly from a top surface of the body in a manner such that a terminal edge of the at least one ear defines a lowermost point along the arc.

* * * * *